US008024826B2

(12) United States Patent
Gogolev

(10) Patent No.: US 8,024,826 B2
(45) Date of Patent: Sep. 27, 2011

(54) U-SHAPE BED

(76) Inventor: Eugene Gogolev, Spring Valley, CA (US)

( * ) Notice: Subject to any disclaimer, the term of this patent is extended or adjusted under 35 U.S.C. 154(b) by 61 days.

(21) Appl. No.: 12/380,539

(22) Filed: Mar. 2, 2009

(65) Prior Publication Data

US 2010/0218313 A1 Sep. 2, 2010

(51) Int. Cl.
*A47C 27/00* (2006.01)

(52) U.S. Cl. ..... 5/411; 5/201; 5/902

(58) Field of Classification Search ..... 5/1, 632, 5/630, 93.1, 400, 401, 402, 411, 200.1, 201, 5/285, 690, 740, 652, 655.9, 902, 922, 636, 5/643, 648, 280, 417, 420, 678, 737, 739, 5/653; 297/219.1, 452.17, 3, 452.27, 452.61, 297/DIG. 1, DIG. 2; D6/382, 392, 393, 595, D6/596, 601, 605, 334, 361, 374, 375, 500–503
See application file for complete search history.

(56) References Cited

U.S. PATENT DOCUMENTS 3,009,172 A * 11/1961 Eidam ..... 5/632
3,175,863 A * 3/1965 Hood ..... 297/452.17
3,729,752 A * 5/1973 Huggins ..... 5/93.1
4,907,306 A * 3/1990 Nakaji ..... 5/632

* cited by examiner

*Primary Examiner* — Robert G Santos
*Assistant Examiner* — Nicholas Polito

(57) ABSTRACT

A U-shape bed is a new design of art furniture structure that includes: a U-shape form base being made from a polystyrene EPS geofoam—super light weight material which provides required strength for support and comfort; a mattress having substantially the same U-shape form and made from memory foam with orthopedic support or other types of materials; and a headboard being made from materials such as a wood, a plastic, or EPS geofoam.

3 Claims, 2 Drawing Sheets

U-SHAPE BED

BACKGROUND OF THE INVENTION

The present invention of a U-shape bed relates to the improvement of a base of a bed for the support of a U-shape mattress. The main support of the structure of a base of a bed with a U-shape form design of one side contributes to having more room and more safety for moving around the bed, because of the absence of sharp corners.

SUMMARY OF THE INVENTION

A primary object of the present invention provides a U-shape bed design and construction, that will make it east and fast to assemble and disassemble without tools, which will save time and effort. This U-shape bed design includes all sizes such as a single, a twin, a queen, a king and different types of materials such as a wood, a plastic, or polystyrene EPS geofoam.

DESCRIPTION OF THE VIEW OF THE DRAWINGS

Figure 1:
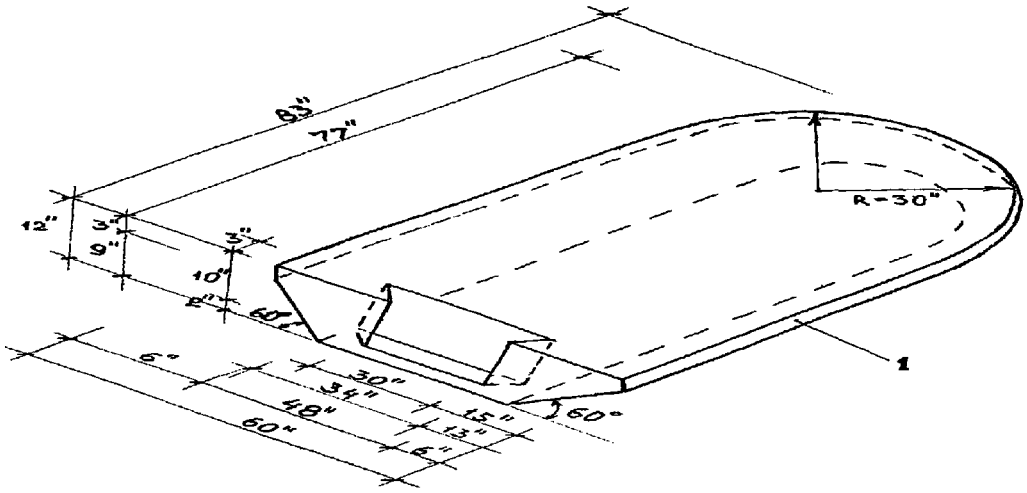
FIG. 1 is a top, rear side perspective view of a top surface of the base of a U-shape form bed (1) having fasteners (4) for assembly and disassembly with a mattress (2) and a headboard (3).
Figure 2:
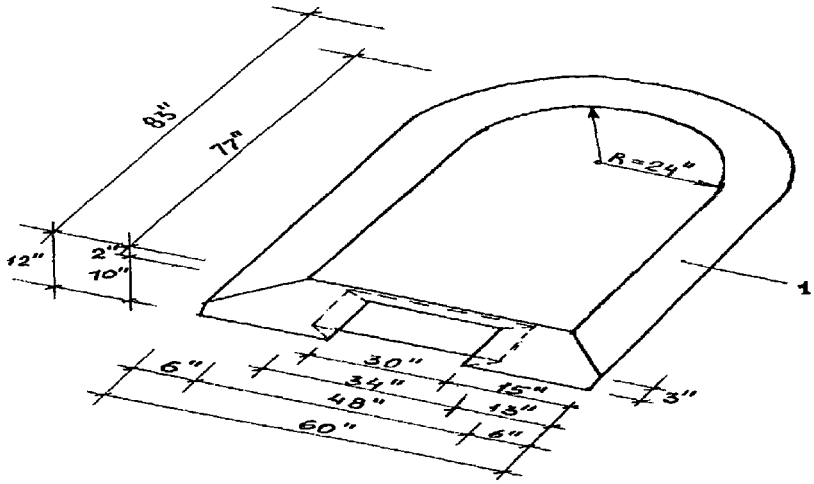
FIG. 2 is a bottom, rear side perspective view of a bottom surface of the base of a U-shape bed (1) having a waterproof material as shown in broken lines and the same fasteners (4) for assembly and disassembly with a headboard (3).
Figure 3:
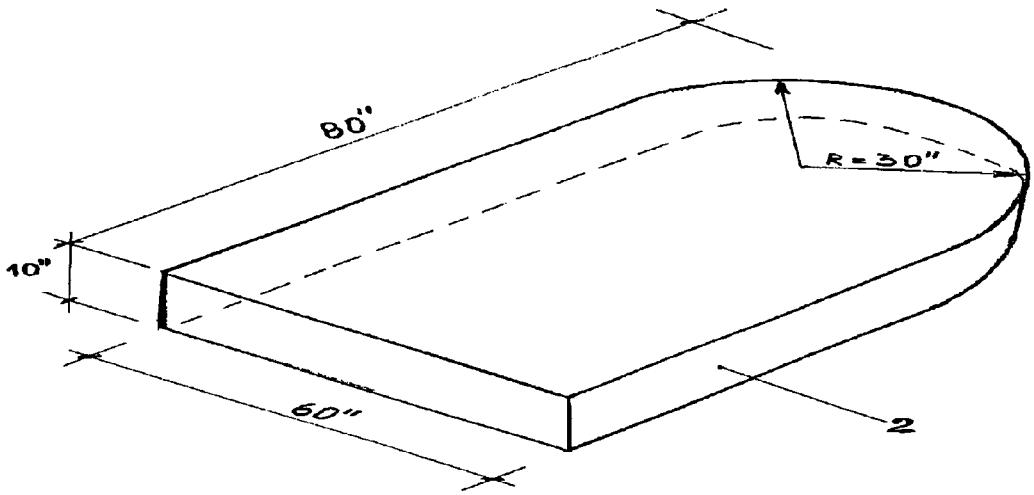
FIG. 3 is a bottom perspective view of a mattress (2) of a U-shape form having the same fasteners (4) for assembly and disassembly with a top surface of the base of the bed (1).
Figure 4:
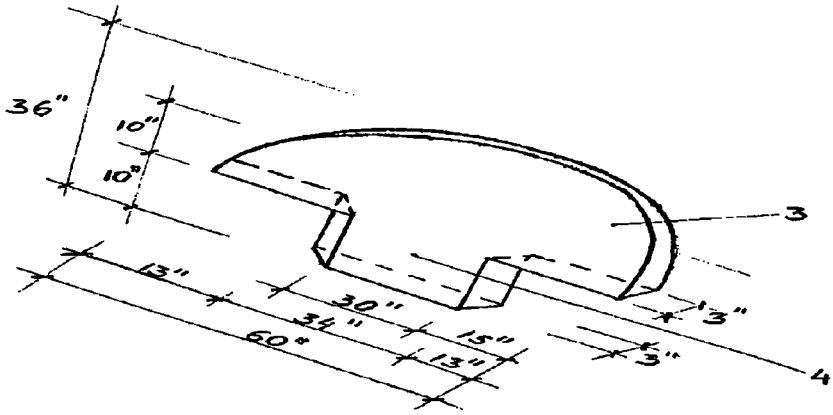
FIG. 4 is a front perspective view of a headboard (3) having the same fasteners (4) for assembly and disassembly with a rear surface of the base of the bed (1).

What is claimed is:

1. A U-shape bed comprising:

a rigid base for holding a mattress having a U-shape form including a head end, a foot end, two longitudinal sides, a top surface and a bottom surface; wherein the longitudinal sides and foot end taper inwardly from the top surface to the bottom surface;

the foot end of the base having a semicircular top edge and a semicircular bottom edge to provide a safe end absent of sharp corners; and the head end of the base having a rectangular top edge, a rectangular bottom edge and fasteners for attaching a headboard.

2. A U-shape bed as defined in claim 1, further comprising: a mattress of substantially the same shape as the base of the bed.

3. A U-shape bed as defined in claim 1, wherein the fasteners provide easy and fast assembly and disassembly between the base of the bed, mattress and headboard.

* * * * *